US011173625B2

(12) United States Patent
Su

(10) Patent No.: US 11,173,625 B2
(45) Date of Patent: Nov. 16, 2021

(54) MULTIFUNCTION PLATE OF WOOD REPAIR APPARATUS

(71) Applicant: Te-Hsing Su, Kaohsiung (TW)

(72) Inventor: Te-Hsing Su, Kaohsiung (TW)

(73) Assignees: Te-Hsing Su, Kaohsiung (TW); Hong Shing Machinery Enterprise Ltd, Kaohsiung (TW)

( * ) Notice: Subject to any disclaimer, the term of this patent is extended or adjusted under 35 U.S.C. 154(b) by 356 days.

(21) Appl. No.: 16/532,520

(22) Filed: Aug. 6, 2019

(65) Prior Publication Data

US 2019/0358848 A1 Nov. 28, 2019

(51) Int. Cl.
*B27G 1/00* (2006.01)
*B27G 11/00* (2006.01)

(52) U.S. Cl.
CPC ..... *B27G 1/00* (2013.01); *B27G 11/00* (2013.01)

(58) Field of Classification Search
CPC ..... B27G 1/00; B27G 11/00
See application file for complete search history.

(56) References Cited

U.S. PATENT DOCUMENTS 1,778,333 A * 10/1930 Neumann ..... B27M 3/04 52/847
RE26,653 E * 8/1969 Skoog ..... B23B 31/261 144/332
4,236,557 A * 12/1980 Marquardt ..... B27G 1/00 144/2.1
4,614,555 A * 9/1986 Smith ..... B27G 1/00 144/332
4,934,228 A * 6/1990 Bolton ..... B07C 5/361 118/37
4,984,172 A * 1/1991 Luminari ..... B27G 1/00 144/332
2007/0209734 A1* 9/2007 Holbert ..... B27D 1/10 144/3.1
2009/0291286 A1* 11/2009 Shen ..... B27D 5/003 428/220

FOREIGN PATENT DOCUMENTS

DE 102015000495 * 1/2006

* cited by examiner

*Primary Examiner* — Christopher R Harmon

(57) ABSTRACT

A multifunction plate of wood repair apparatus includes a feeding device for moving raw plates of wood; a cutting and gluing device disposed downstream of the feeding device for cutting front and rear ends of each plate of wood and joining adjacent plates of wood together as a unit of predetermined size by gluing; a repairing device disposed downstream of the cutting and gluing device for identifying locations of damaged areas of the plates of wood, the repairing device including an upper mold, a female mold under the upper mold, a chips exiting device under the female mold, a lower mold under the chips exiting device, and a drive device under the lower mold and operatively connected to both the upper mold and the lower mold; and a collecting device disposed downstream of the repairing device for collecting the repaired plates of wood.

7 Claims, 8 Drawing Sheets

MULTIFUNCTION PLATE OF WOOD REPAIR APPARATUS

BACKGROUND OF THE INVENTION

1. Field of the Invention

The invention relates to repair apparatuses and more particularly to a multifunction plate of wood repair apparatus for increasing use percentage of the plate of wood.

2. Description of Related Art

Steps performed by a conventional plate of wood repair apparatus for repairing a plate of wood 3 are shown in FIG. 1 in which the plate of wood 3 is examined to find damaged areas 31. If the damaged areas 31 exist, a first cut forward of the damaged area 31 and a second cut rearward of the damaged area 31, parallel to the first cut, are performed. Next, the rectangular cut area including the damaged area 31 is removed. Finally, the remaining portions of the plate of wood 3 are joined.

However, the removed area increases as the number of the damaged areas 31 increase and a substantial portion of each cut area is intact. Unfortunately, these cut areas are discarded. Thus, the percentage of the plate of wood 3 being used is very low and this is a waste. Further, the plate of wood repair apparatus is required to temporarily stop, cut and reactivate in the repairing process. Unfortunately, it is disadvantageous because these steps may greatly consume energy and the components are prone to wear and malfunction.

Thus, the need for improvement still exists.

SUMMARY OF THE INVENTION

It is therefore an object of the invention to provide a multifunction plate of wood repair apparatus for greatly increase the use percentage of the plate of wood.

It is another object of the invention to provide a multifunction plate of wood repair apparatus for greatly decreasing energy consumption and components wear.

For achieving above and other objects, the invention provides a method of repairing a plate of wood comprising the steps of activating a feeding device to feed raw plates of wood; activating a cutting and gluing device to cut front and rear ends of each plate of wood and joining a plurality of adjacent plates of wood together as a unit of predetermined size by gluing; activating a repairing device to identify locations of damaged areas of the plates of wood, moving a drilling device to a position above the damaged areas, activating the drilling device to punch each damaged area so that a hole of predetermined size is formed on the damaged area, and filling the holes with a plurality of filling members of a predetermined material, and cutting two sides of the plates of wood; and activating a collecting device to collect the repaired plates of wood.

The invention further provides a multifunction plate of wood repair apparatus comprising a feeding device, a cutting and gluing device, a repairing device, and a collecting device wherein the feeding device is configured to move a plurality of raw plates of wood; the cutting and gluing device is disposed downstream of the feeding device and is configured to cut front and rear ends of each plate of wood and join a plurality of adjacent ones of the plates of wood together as a unit of predetermined size by gluing; the repairing device is disposed downstream of the cutting and gluing device and is configured to identify locations of a plurality of damaged areas of the plates of wood, the repairing device includes an upper mold, a female mold under the upper mold, a chips exiting device under the female mold, a lower mold under the chips exiting device, and a drive device under the lower mold and operatively connected to both the upper mold and the lower mold; and the collecting device is disposed downstream of the repairing device and is configured to is collect the repaired plates of wood.

The invention has the following advantages and benefits in comparison with the conventional art: the damaged areas are punched and filled with filling members of a predetermined material so that an area of the plate of wood that can be used is increased greatly. The number of cutting is decreased to one by cutting front and rear ends of the plate of wood. Thus, the plate of wood repair apparatus is not required to temporarily stop, cut and reactivate in the repairing process. This can greatly decreases energy consumption and components wear. Further, it can greatly decrease the manufacturing cost. Furthermore, it is environmentally friendly.

The above and other objects, features and advantages of the invention will become apparent from the following detailed description taken with the accompanying drawings.

DETAILED DESCRIPTION OF THE INVENTION

Figure 1:
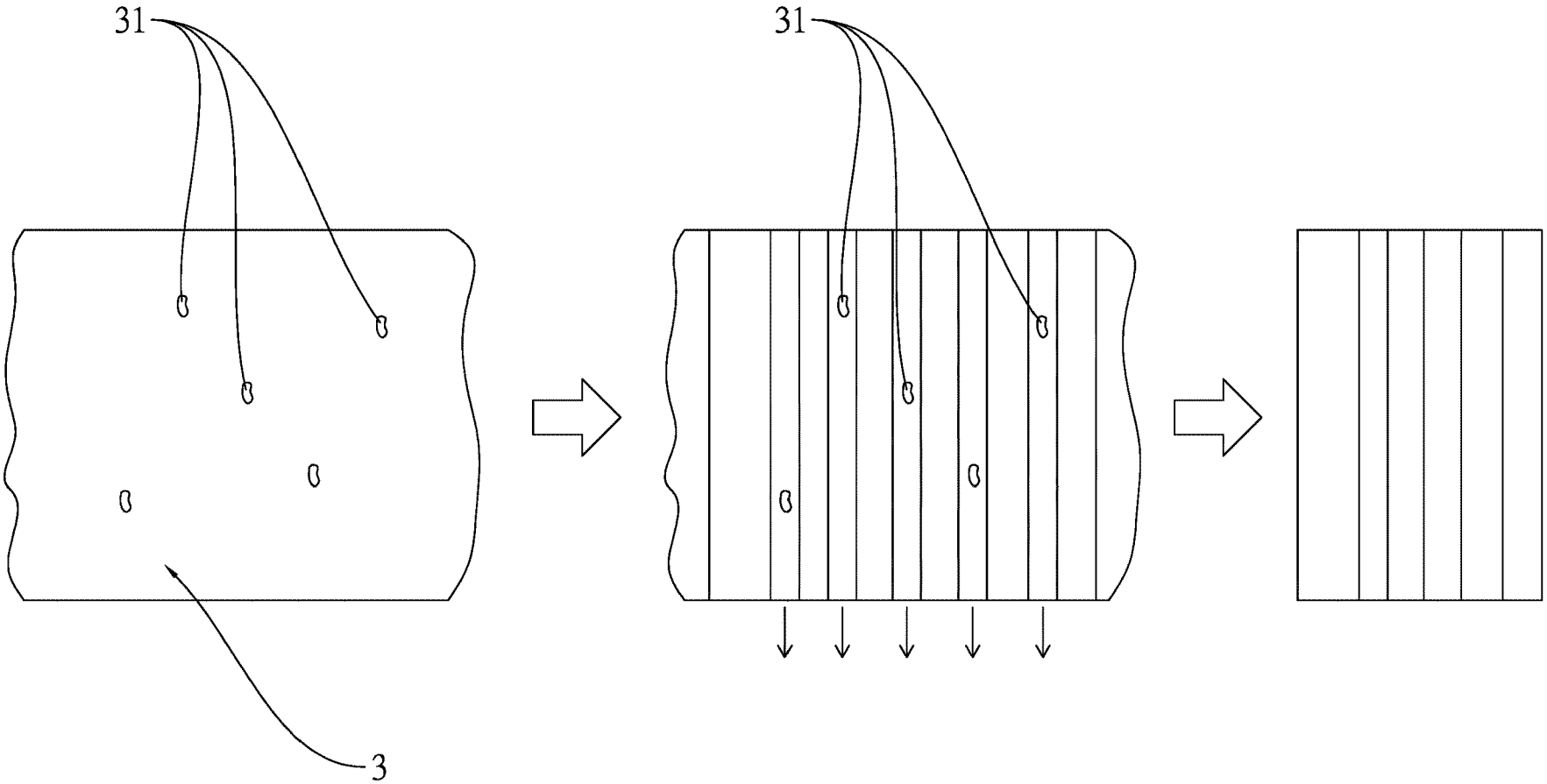
Prior Art FIG.1
FIG. 1 schematically depicts steps performed by a conventional plate of wood repair apparatus for repairing a plate of wood.
Figure 2:
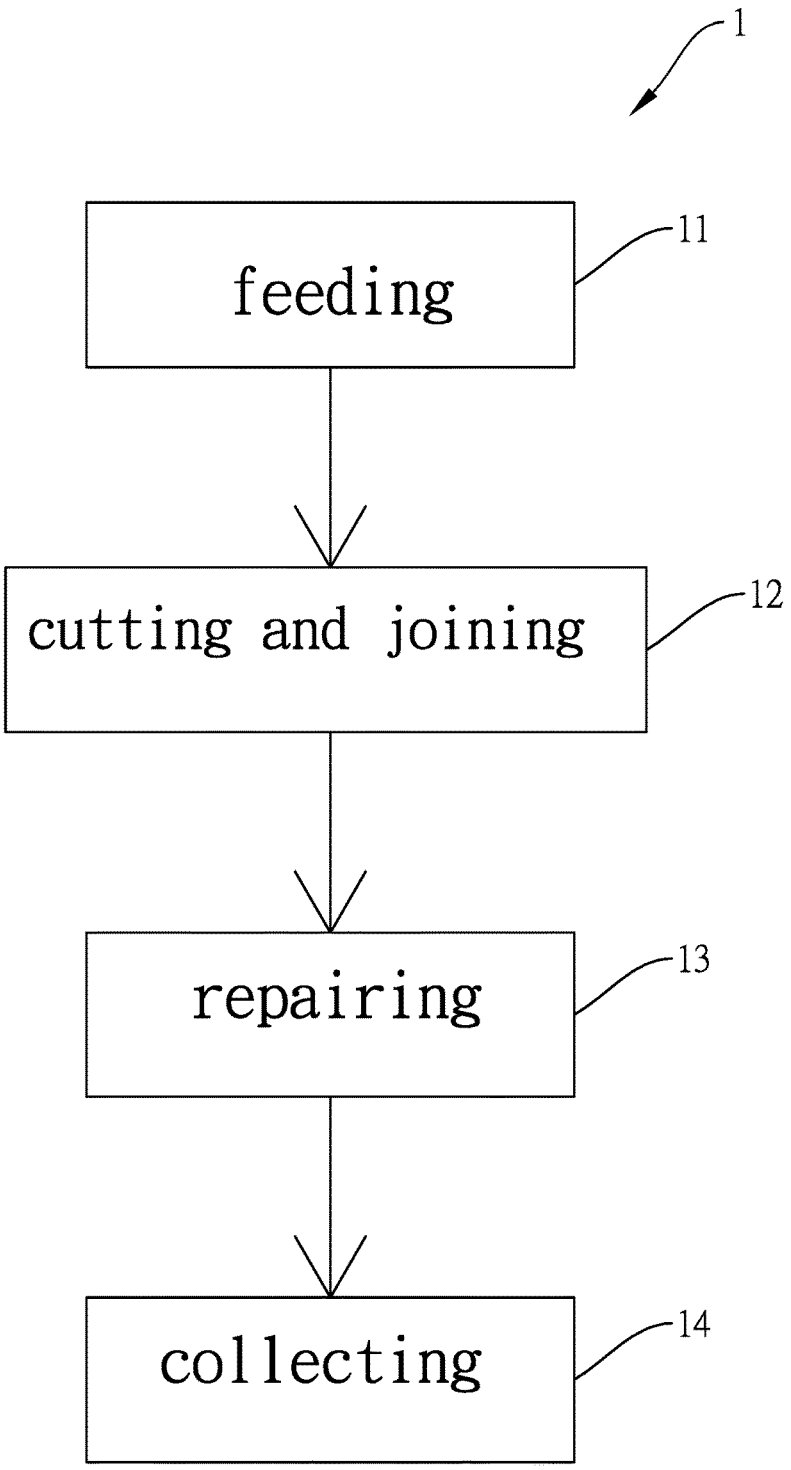
FIG. 2 is a flow chart of a method of repairing a plate of wood according to the invention.
Figure 3:
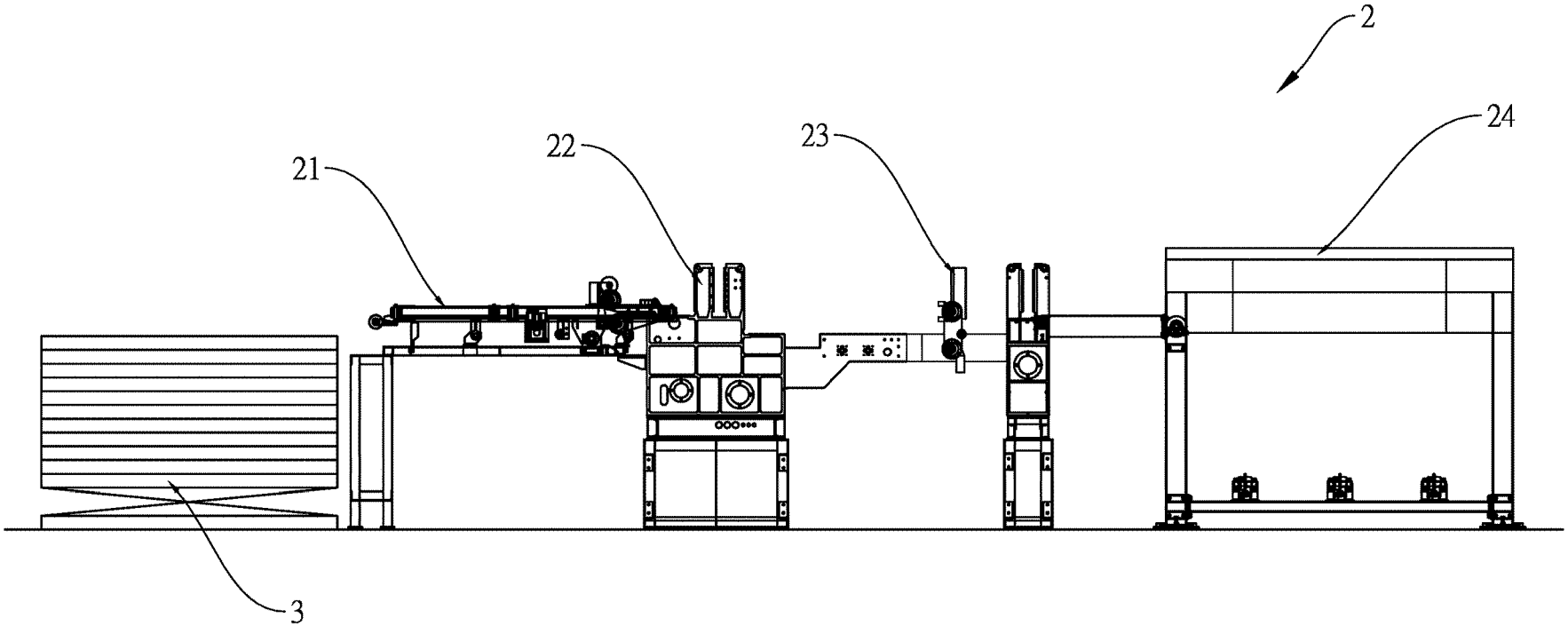
FIG. 3 schematically depicts a multifunction plate of wood repair apparatus according to a first preferred embodiment of the invention.
Figure 4:
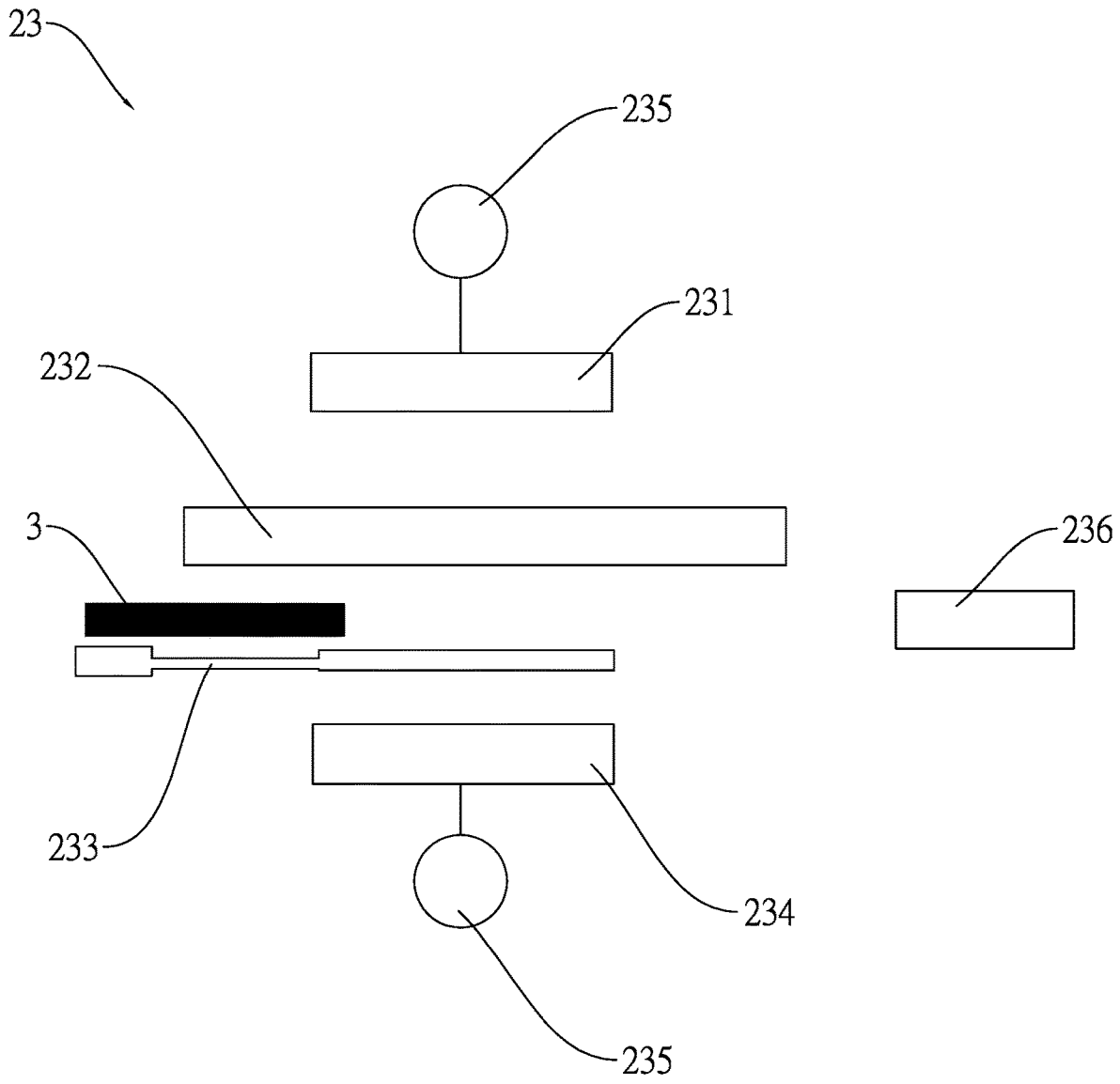
FIG. 4 schematically depicts the repairing device.

Referring to FIG. 2, a method 1 of repairing a plate of wood 3 in accordance with the invention is illustrated. Referring to FIGS. 2 to 4, the method 1 comprises the following steps:

Step 11: activating a feeding device 21 to feed raw plates of wood 3 having a width of 900 to 1300 mm or 1630 to 2550 mm.

Step 12: activating a cutting and gluing device 22 to cut front and rear ends of each plate of wood 3 and joining a plurality of adjacent plates of wood 3 together as a unit of predetermined size by gluing.

Step 13: activating a repairing device 23 to identify locations of damaged areas 31 of the plates of wood 3, moving a drilling device to a position above the damaged areas 31, activating the drilling device to punch each damaged area 31 so that a hole of predetermined size is formed on the damaged area 31, and filling the holes with a plurality of filling members 32 of a predetermined material, and cutting two sides of the plates of wood 3.

Step 14: activating a collecting device 24 to collect the repaired plates of wood 3.

As shown in FIG. 3 specifically, a multifunction plate of wood repair apparatus 2 according to a first preferred embodiment of the invention comprises the feeding device 21, the cutting and gluing device 22, the repairing device 23 and the collecting device 24.

In detail, the feeding device 21 is configured to move the raw plates of wood 3. The cutting and gluing device 22 is disposed downstream of the feeding device 21 and configured to cut front and rear ends of each plate of wood 3 and join a plurality of adjacent plates of wood 3 together as a unit of predetermined size by gluing. The repairing device 23 is disposed downstream of the cutting and gluing device 22 and configured to identify locations of damaged areas 31 of the plates of wood 3.

As shown in FIG. 4 specifically, the repairing device 23 includes an upper mold 231, a female mold 232 under the upper mold 231, a chips exiting device 233 under the female mold 232, a lower mold 234 under the chips exiting device 233, and a drive device 235 under the lower mold 234 and operatively connected to both the upper mold 231 and the lower mold 234. Preferably, the drive device 235 is a pneumatic motor, hydraulic motor, servo motor, or sensor type servo motor. Additionally, a trimming device 236 is disposed downstream of the repairing device 23 and configured to trim the sides of the repaired plates of wood 3.

The collecting device 24 is disposed downstream of the repairing device 23 and configured to collect the repaired plates of wood 3.

Figure 5:
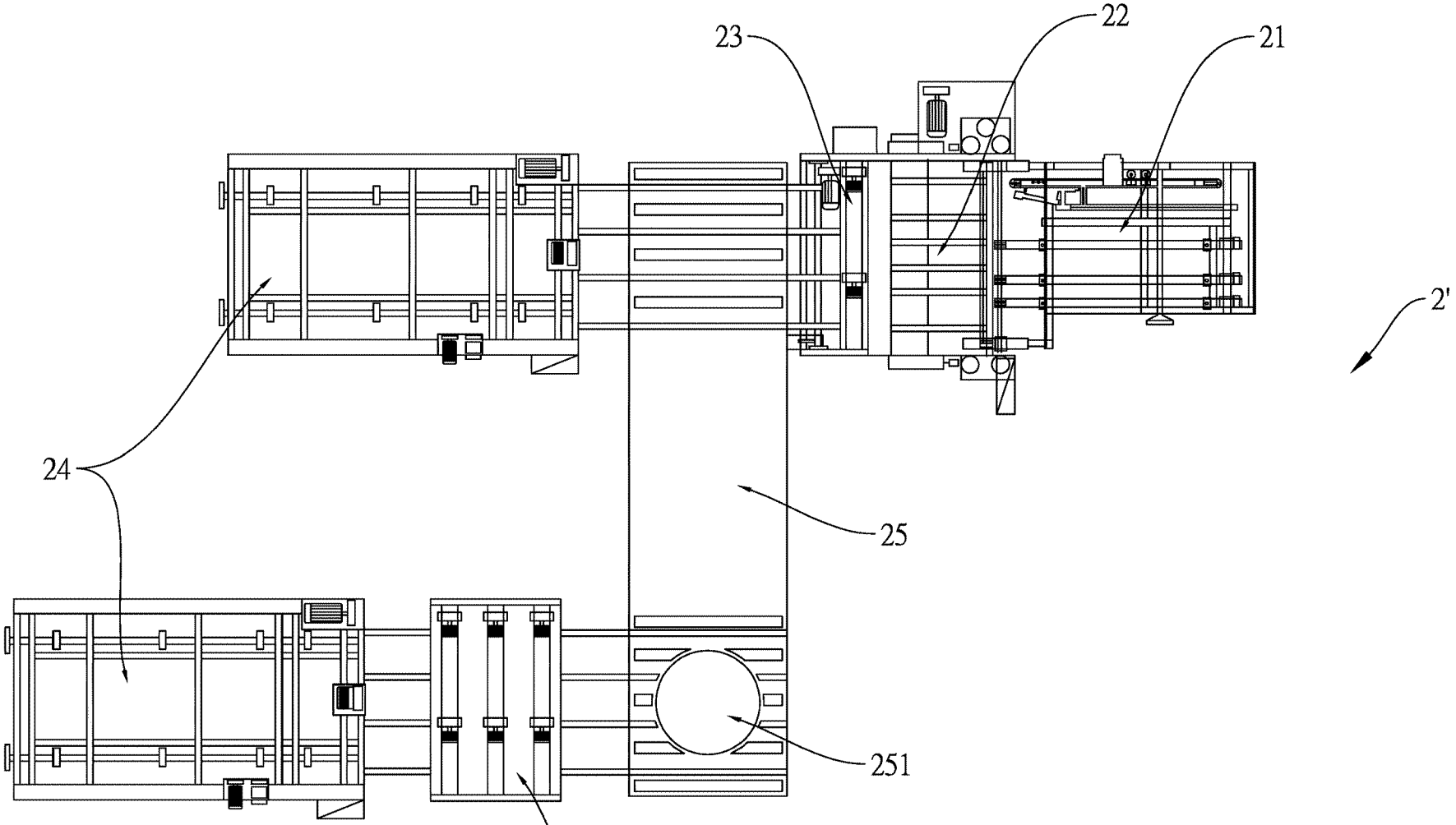
FIG. 5 schematically depicts a multifunction plate of wood repair apparatus according to a second preferred embodiment of the invention.

Referring to FIG. 5, a multifunction plate of wood repair apparatus 2' according to a second preferred embodiment of the invention is shown. The characteristics of the second preferred embodiment are substantially the same as that of the first preferred embodiment except the following: a diverting device 25 is provided between the repairing device 23 and the collecting device 24 and a joining device 26 is provided between the collecting device 24 and the diverting device 25 in which the joining device 26 is provided upstream of the collecting device 24 and the diverting device 25 is provided upstream of the joining device 26. The diverting device 25 includes a turning member 251 for changing the moving direction of the plate of wood 3. The joining device 26 glues a plurality of repaired plates of wood 3 together as a unit of predetermined size (i.e., a plate of wood 3 having a larger size). The gluing is done by either hot molten adhesive or hot molten wire. The joining device 26 includes upper and lower blades for cutting the repaired plate of wood prior to gluing. The upper and lower blades are blades having a toothed cutting edge or a smooth cutting edge.

Figure 6:
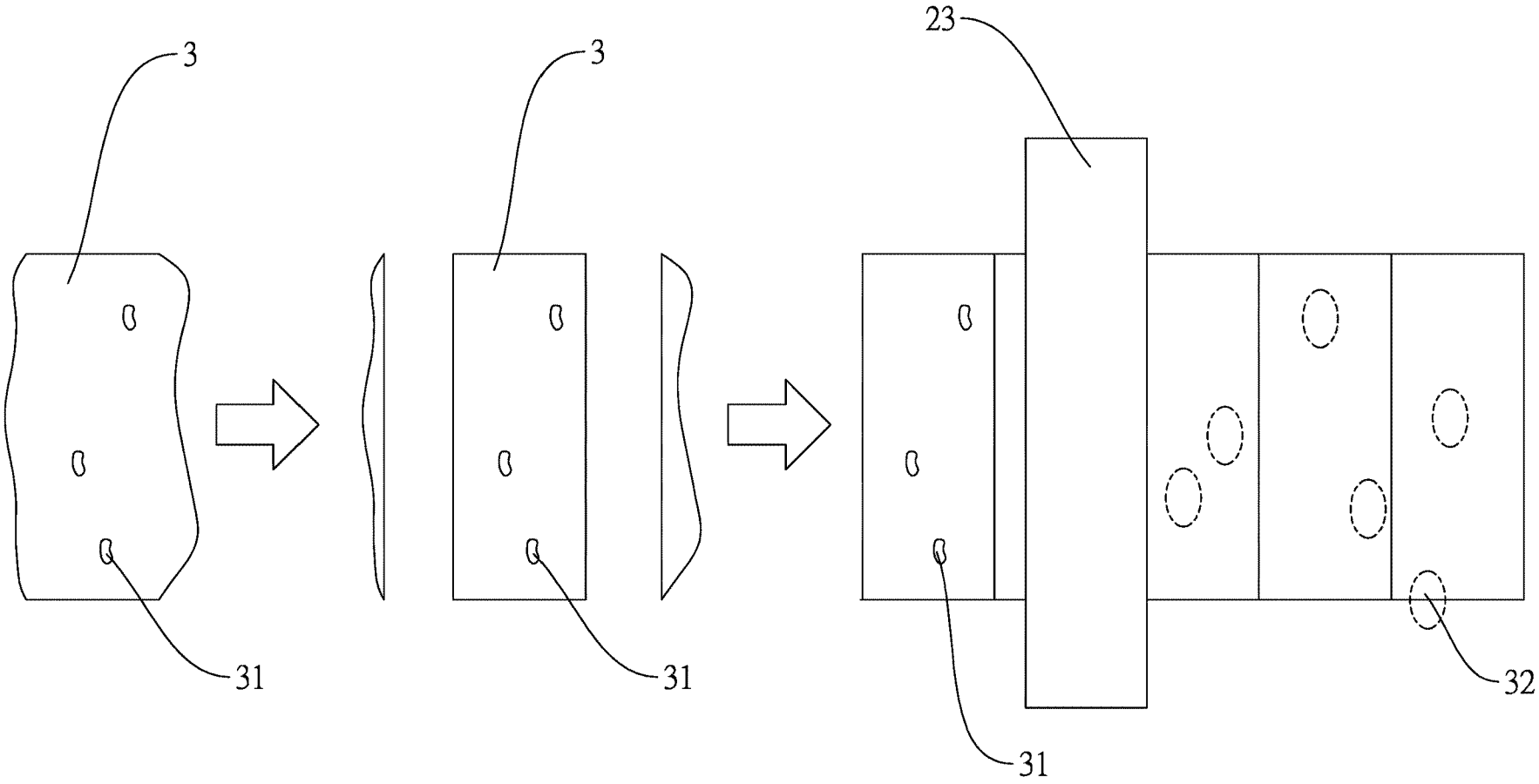
FIG. 6 schematically depicts steps of repairing a plate of wood of the invention.
Figure 7:
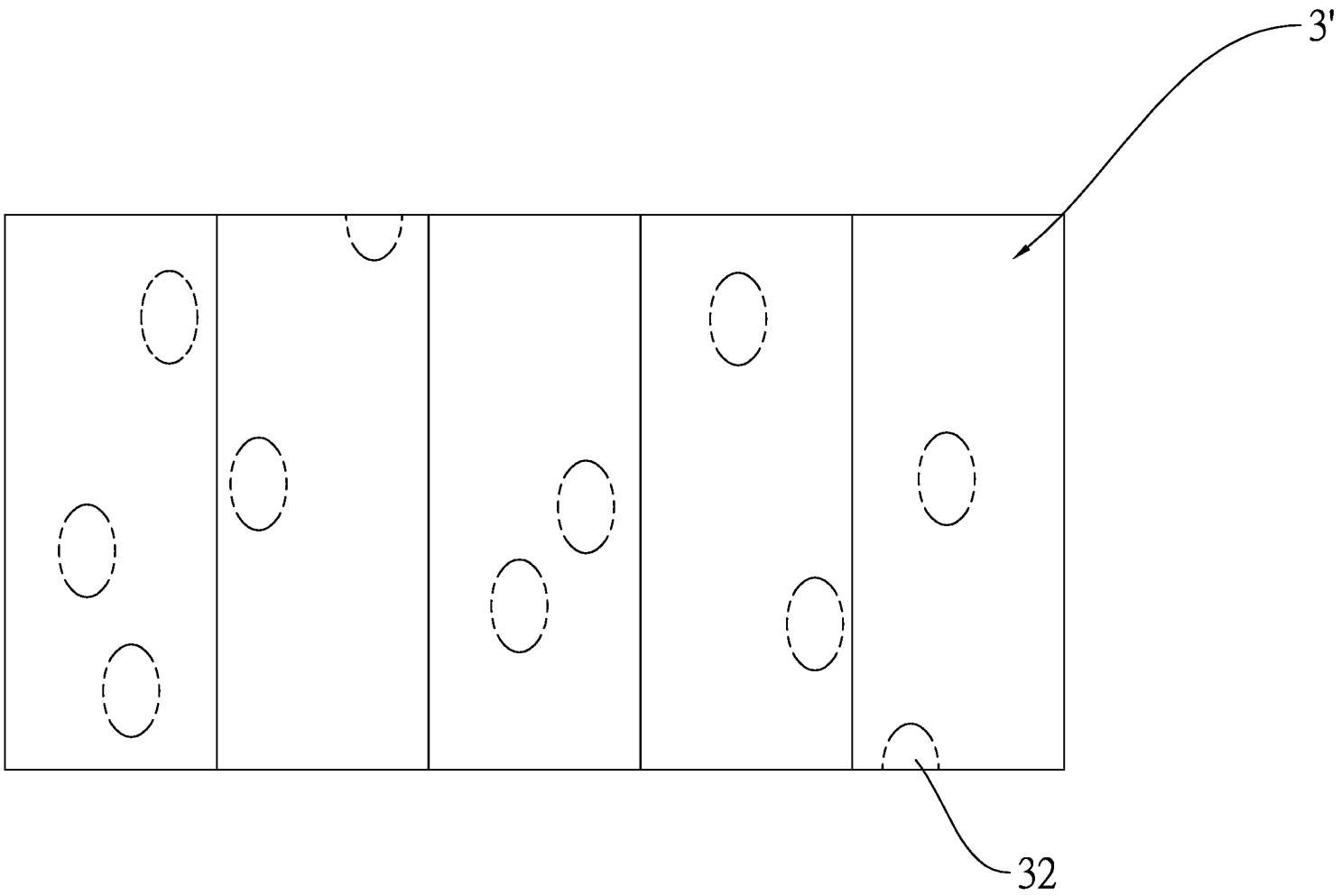
FIG. 7 is a top view of the repaired plate of wood.
Figure 8:
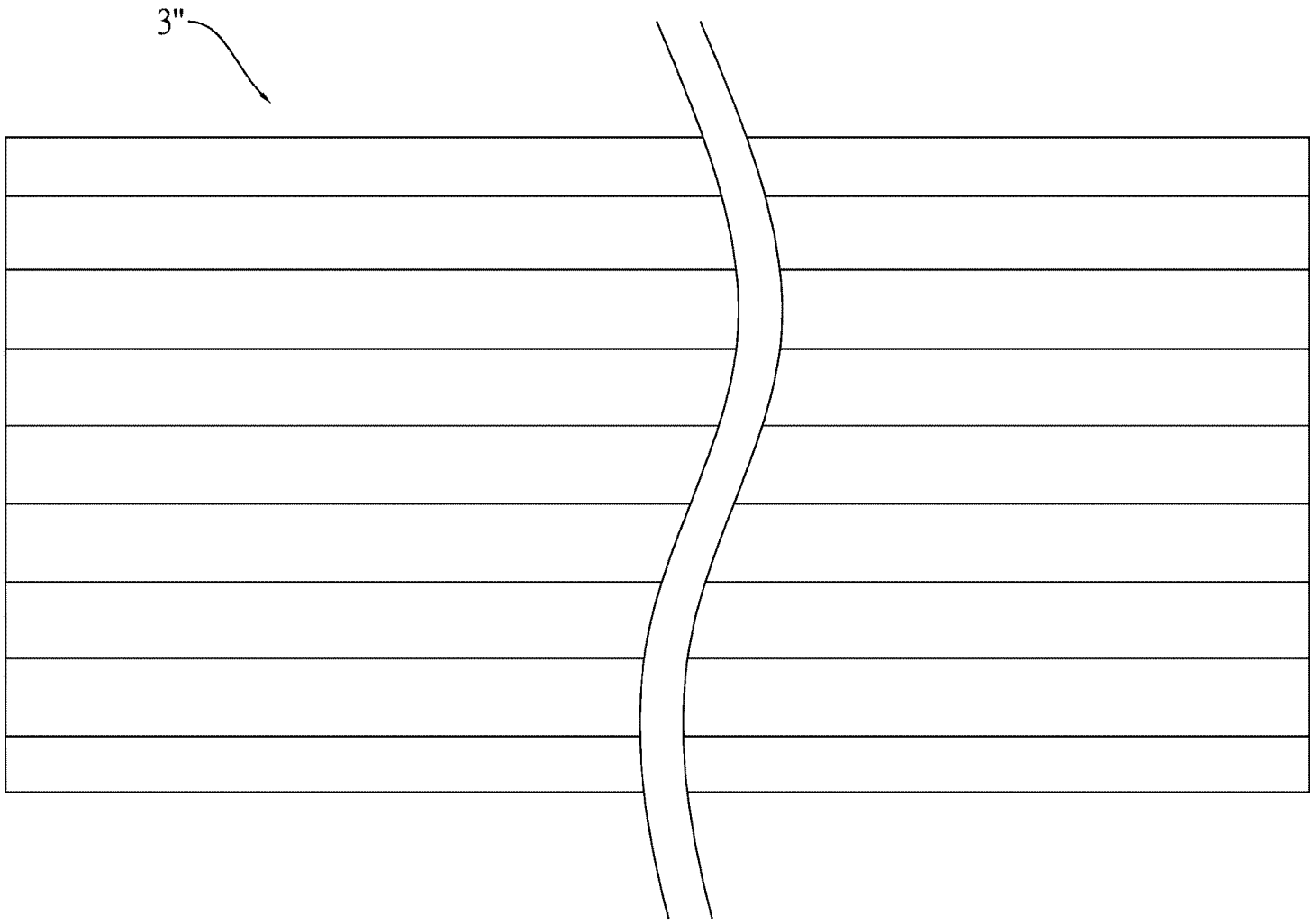
FIG. 8 is a top view of a repaired plate of wood having a larger size.

Referring to FIGS. 6, 7 and 8 in conjunction with FIGS. 3 and 4, repairing steps of the invention are further illustrated and described. The feeding device 21 moves the raw plates of wood 3 from a storage to the cutting and gluing device 22. The cutting and gluing device 22 cuts front and rear ends of the plate of wood 3 about 30 mm and joins a plurality of adjacent plates of wood 3 together as a unit of predetermined size by gluing. The resized plates of wood 3 are then sent to the repairing device 23 for repairing in which front and rear ends of the resized plate of wood 3 are further cut as desired. In the repairing device 23, the resized plate of wood 3 is disposed between the female mold 232 and the lower mold 234. Next, the repairing device 23 identifies locations of damaged areas 31 of the plates of wood 3. Next, the female mold 232 is moved to a position above the damaged areas 31. Next, the drive device 235 is activated to lower the upper mold 231 to a position about 0.5 mm above the female mold 232. Next, the lower mold 234 is lifted to sandwich the plate of wood 3 between the female mold 232 and the lower mold 234. Next, a drilling device is activated to punch each damaged area 31 so that a hole of predetermined size is formed on the damaged area 31. Next, the holes are filled by the filling members 32 of a predetermined material. Next, the lower mold 234 is lowered and the chips exiting device 233 is activated to discharge chips generated by the punching out of the repairing device 23. Next, above steps are repeated until all damaged areas 31 are repaired. Next, the trimming device 236 is activated to trim the sides of the repaired plates of wood 3. Finally, the collecting device 24 is activated to collect the repaired plates of wood 3 and stack same in a specified place. This finishes the repairing of the plates of wood 3.

For manufacturing plates of wood 3" having a larger size, likewise the feeding device 21 moves the raw plates of wood 3 to the cutting and gluing device 22. The cutting and gluing device 22 performs cutting and joining operations. A plate of wood having a desired size (i.e., length) cannot be produced at one operation. Thus, the repaired plate of wood 3' finished by the cutting and gluing device 22 is shorter than the desired plate of wood. Next, the repairing device 23 repairs the damaged areas 31 of the shorter plate of wood 3 in a manner as discussed above. Thus, a detailed description thereof is omitted herein for the sake of brevity. After repairing the plate of wood 3, the repaired plate of wood 3' is moved by the diverting device 25. Next, the turning member 251 changes the moving direction of the plate of wood 3' 90-degree prior to sending same to the joining device 26. Next, the upper and lower blades of the joining device 26 cut the repaired plates of wood 3' prior to gluing them together to finish a plate of wood 3 having a desired length. Finally, the collecting device 24 is activated to collect the repaired plates of wood 3 and stack same in a specified place.

The invention has the following characteristics and advantages: the damaged areas are punched and filled with filling members of a predetermined material so that an area of the plate of wood that can be used is increased greatly. The number of cutting is decreased to one by cutting front and rear ends of the plate of wood. Thus, the plate of wood repair apparatus is not required to temporarily stop, cut and reactivate in the repairing process. This can greatly decreases energy consumption and components wear. Further, it can greatly decrease the manufacturing cost. Furthermore, it is environmentally friendly.

While the invention has been described in terms of preferred embodiments, those skilled in the art will recognize that the invention can be practiced with modifications within the spirit and scope of the appended claims.

What is claimed is:

1. A multifunction plate of wood repair apparatus, comprising a feeding device, a cutting and gluing device, a repairing device, and a collecting device wherein:

the feeding device is configured to move a plurality of raw plates of wood;

the cutting and gluing device is disposed downstream of the feeding device and is configured to cut front and rear ends of each plate of wood and join a plurality of adjacent ones of the plates of wood together as a unit of predetermined size by gluing;

the repairing device is disposed downstream of the cutting and gluing device and is configured to identify locations of a plurality of damaged areas of the plates of wood, the repairing device includes an upper mold, a female mold under the upper mold, a chips exiting device under the female mold, a lower mold under the chips exiting device, and a drive device under the lower mold and operatively connected to both the upper mold and the lower mold; and the collecting device is disposed downstream of the repairing device and is configured to is collect the repaired plates of wood.

2. The multifunction plate of wood repair apparatus of claim 1, wherein the drive device is a pneumatic motor, hydraulic motor, servo motor, or sensor type servo motor.

3. The multifunction plate of wood repair apparatus of claim 1, further comprising a trimming device disposed downstream of the repairing device.

4. The multifunction plate of wood repair apparatus of claim 1, further comprising a diverting device disposed between the repairing device and the collecting device.

5. The multifunction plate of wood repair apparatus of claim 4, wherein the diverting device includes a turning member.

6. The multifunction plate of wood repair apparatus of claim 4, further comprising a joining device disposed between the collecting device and the diverting device.

7. The multifunction plate of wood repair apparatus of claim 6, wherein the joining device is operatively connected to the collecting device.

* * * * *